US006655997B2

(12) United States Patent
Lam et al.

(10) Patent No.: US 6,655,997 B2
(45) **Date of Patent: *Dec. 2, 2003**

(54) ELECTRICAL CONNECTOR WITH A RELEASABLE HOUSING

(76) Inventors: Chua Sze Lam, 14A Boscombe Road, Singapore 439755 (SG); Kiat-Hup Ng, Block 282, #06-434, Choa Chu Kang Avenue 3, Singapore 680282 (SG); Nai Hock Lwee, 56, West Coast Crescent, #03-12, Singapore, 128038 (SG)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/882,565

(22) Filed: Jun. 25, 1997

(65) Prior Publication Data

US 2001/0044234 A1 Nov. 22, 2001

(51) Int. Cl.[7] ..... H01R 13/432
(52) U.S. Cl. ..... 439/746; 439/78; 439/83
(58) Field of Search ..... 439/78, 79, 80, 439/81, 82, 83, 189, 516, 621, 746, 747, 748

(56) References Cited

U.S. PATENT DOCUMENTS

| | | | | |
|---|---|---|---|---|
| 3,601,751 A | * | 8/1971 | Pauza | 339/176 MP |
| 3,697,926 A | | 10/1972 | Krafthefer | |
| 3,990,863 A | | 11/1976 | Palmer | 29/203 |
| 3,998,518 A | | 12/1976 | Mathe | |
| 4,006,961 A | | 2/1977 | Langenbach | |
| 4,078,714 A | | 3/1978 | Spirig | 228/264 |
| 4,274,576 A | | 6/1981 | Shariff | 228/264 |
| 4,327,472 A | | 5/1982 | Krzeptowski | 29/426 |
| 4,436,242 A | | 3/1984 | Shisler et al. | 228/264 |
| 4,561,586 A | | 12/1985 | Abel et al. | 228/264 |
| 4,569,473 A | | 2/1986 | Guiliano | 228/264 |
| 4,635,355 A | | 1/1987 | Brinkman et al. | |
| 4,659,002 A | | 4/1987 | Wallgren et al. | 228/8 |
| 4,877,175 A | | 10/1989 | Jones et al. | 228/102 |
| 4,897,047 A | | 1/1990 | Connell et al. | 439/189 |
| 4,934,582 A | | 6/1990 | Bertram et al. | 228/191 |
| 5,072,874 A | | 12/1991 | Bertram et al. | 228/264 |
| 5,148,969 A | | 9/1992 | Boucher et al. | 228/264 |
| 5,154,793 A | | 10/1992 | Wojnarowski et al. | 156/344 |
| 5,174,016 A | | 12/1992 | Todd | 29/762 |
| 5,216,803 A | | 6/1993 | Nolan et al. | 29/829 |
| 5,278,393 A | | 1/1994 | Kim | 219/228 |
| 5,281,165 A | | 1/1994 | McCleerey et al. | 439/510 |
| 5,326,016 A | | 7/1994 | Cohen et al. | 228/264 |
| 5,542,601 A | | 8/1996 | Fallon et al. | 228/119 |
| 5,553,766 A | | 9/1996 | Jackson et al. | 228/13 |
| 5,603,642 A | | 2/1997 | Shinji et al. | 439/752 |

FOREIGN PATENT DOCUMENTS

| | | |
|---|---|---|
| DE | 93 09 495.7 | 9/1993 |
| EP | 0 280 450 | 8/1988 |
| EP | 0 657 965 A2 | 6/1995 |
| EP | 0 829 925 A1 | 3/1998 |
| FR | 2.191.400 | 6/1972 |
| GB | 2 132 038 A | 6/1984 |
| WO | WO96/07204 | 12/1986 |

* cited by examiner

*Primary Examiner*—Alexander Gilman
(74) *Attorney, Agent, or Firm*—Hoffmann & Baron, LLP

(57) ABSTRACT

An electrical connector is provided which includes an insulative housing with an electrical contact inserted therein. The electrical contact includes a solder tail at one end, a deflectable wiping element at the other end, and an elongate contact body therebetween. The contact body includes a deflectable tang acutely extending therefrom. The tang engages a locking shoulder in the cavity so as to prevent the removal of the contact from the cavity. An access aperture in the housing communicates with the cavity to allow deflecting engagement of the tang away from the locking shoulder so that the contact may be removed from the cavity.

4 Claims, 4 Drawing Sheets

ELECTRICAL CONNECTOR WITH A RELEASABLE HOUSING

FIELD OF THE INVENTION

The present invention relates to electrical connectors. More specifically, the present invention relates to the field of electrical connectors for printed circuit boards.

BACKGROUND OF THE INVENTION

It is well known in the art to provide an electrical connector which includes contacts having solder tails which may be soldered to the solder pads of a printed circuit board (PCB). The connectors of the prior art provide connectors housings having the electrical contacts securely retained therein so that once the connector is soldered to the PCB the connection is non-removably affixed to the PCB.

Should the PCB require rework, the typical approach for effecting recovery of the PCB requires cutting the contacts proximate to the solder tails to separate the remainder of the connector from the PCB, and then severing the solder connection between the PCB and the solder tail by applying heat or by other method known in the art. The PCB could then be cleaned and reworked so that a new connector could be mounted to the solder pads of the PCB. In these rework procedures, however, the removal of the connector tends to result in the twisting of the contacts while cutting the solder tails. Twisting of the contacts can translate through the solder pads of the PCB to cause scratching and delamination of the PCB, or lifting or detaching of the solder pads from the PCB. Such damage can render the PCB un-reusable.

There is therefore a need in the art for a connector design which provides a quick release between the contacts and the housing so as to minimize the damage to or delamination of the PCB pad during rework. This new design would obviate the need for cutting the contact while it remains soldered to the PCB by providing access to detach the contacts from the housing. This new design would thereby eliminate the chance of damage to or delamination of the masked surfaces of the PCB by the cutting process.

SUMMARY OF THE INVENTION

It is therefore an object of the present invention to provide a connector the housing of which may be easily detached from the contacts contained therein.

It is another object of the present invention to provide a connector for a PCB which minimizes the chance of damage to the PCB or its solder pads during rework of the PCB.

It is still another object of the present invention to provide a connector for a PCB which obviates the need for cutting of the solder tails connecting the connector to the PCB.

It is yet another object of the present invention to provide a connector for a PCB which facilitates the recovery process.

These and other objects are obtained by the present invention by providing a connector having a releasable connector housing. The connector supports a number of elongate contacts in a number of elongate cavities defined by the connector housing. Each contact includes a solder tail at one end, a deflectable wiping connection element at the other end, and a contact body therebetween. The contact body includes a deflectable tang extending acutely therefrom in interfering engagement with a locking shoulder extending in the cavity. The housing also defines a tang access aperture in communication with each cavity so as to render each tang accessible therethrough. A separation tool having a prong for each tang may engage the housing through each access aperture to deflect the tangs away from the interfering engagement with the locking shoulders. With each tang simultaneously out of interfering engagement with the locking shoulders, the housing may be separated from the contacts while the contacts are still soldered to a printed circuit board. The solder tails may then be disconnected from the printed circuit board without the need for cutting the contacts.

DETAILED DESCRIPTION OF THE PREFERRED EMBODIMENT

Figure 1:
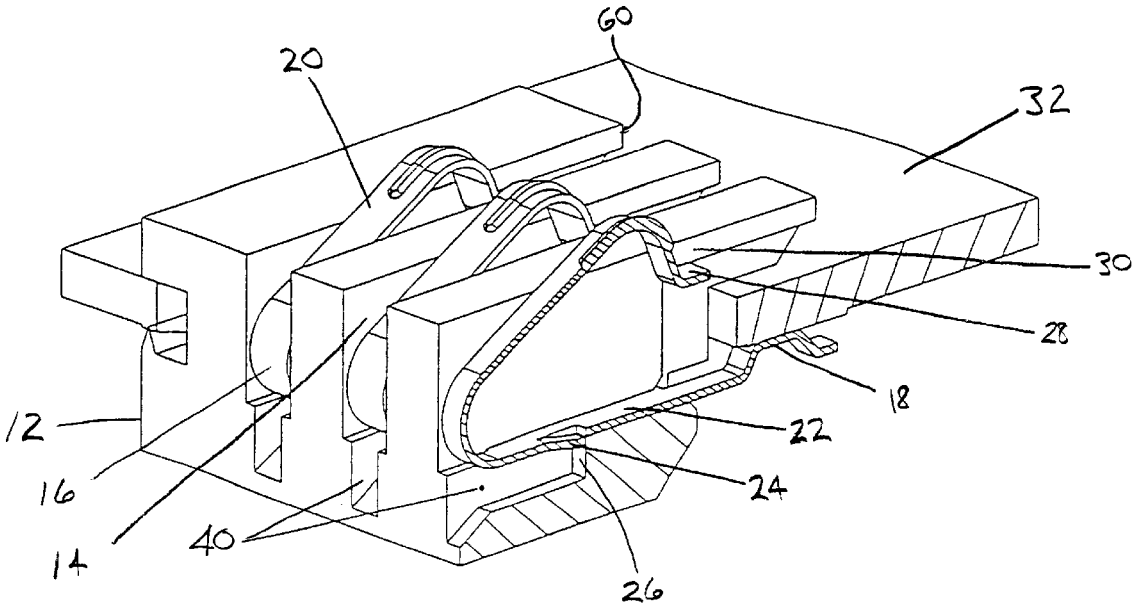
FIG. 1 is a cut-away view of a connector of the present invention having an in-line access aperture.

FIG. 1 shows a connector 10 of the present invention. Connector 10 includes an elongate housing 12 having a plurality of spaced-apart elongate cavities 14 extending therealong. Housing 12 is preferably formed of a suitable insulative molded plastic that complies with the UL94-V0 standard such as polyphenylene sulfide, liquid crystal polymer, polyphthalamide, or nylon 46.

Within each cavity 14 housing 12 supports an electrical contact 16. Each contact 16 includes solder tail 18 at one end, deflectable wiping engagement member 20 at the other end, and elongate contact body 22 therebetween. Contact body 22 supports deflecting tang 24 at an acute angle thereto. When contact 16 is inserted into housing 12, tang 24 extends in interfering engagement with locking shoulder 26 formed in housing 12. Wiping engagement member 20 terminates at tab 28. Tab 28 extends transversely to contact 16 so as to abuttingly engage cavity shoulder 30.

Figure 3:
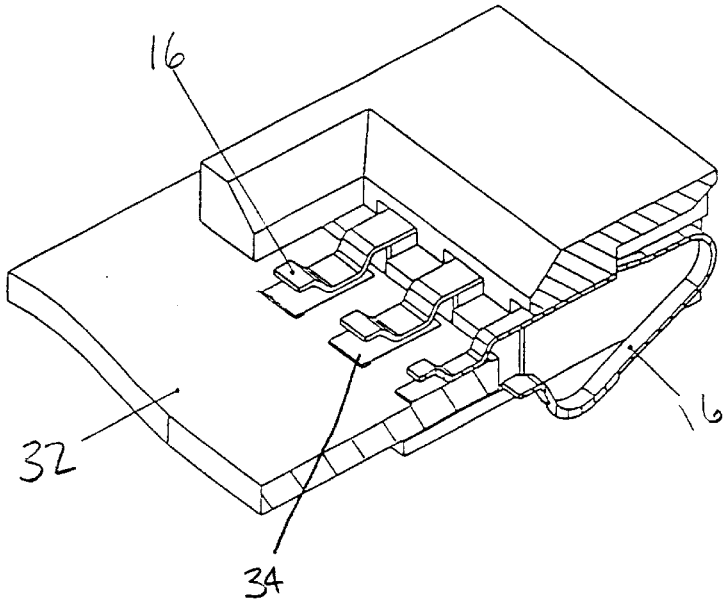
FIG. 3 is a cut-away view from the underside of the connector of FIG. 1 soldered to a PCB.

With additional reference to FIG. 3, solder tail 18 is connected to printed circuit board (PCB), 32. Preferably, solder tail 18 is soldered to solder pad 32 as is well known in the art for connecting an electrical contact to a PCB. Whereas contact 16 is thereby soldered to PCB 32, contact 16 is simultaneously retained in housing 12 by mechanical interference.

Figure 2:
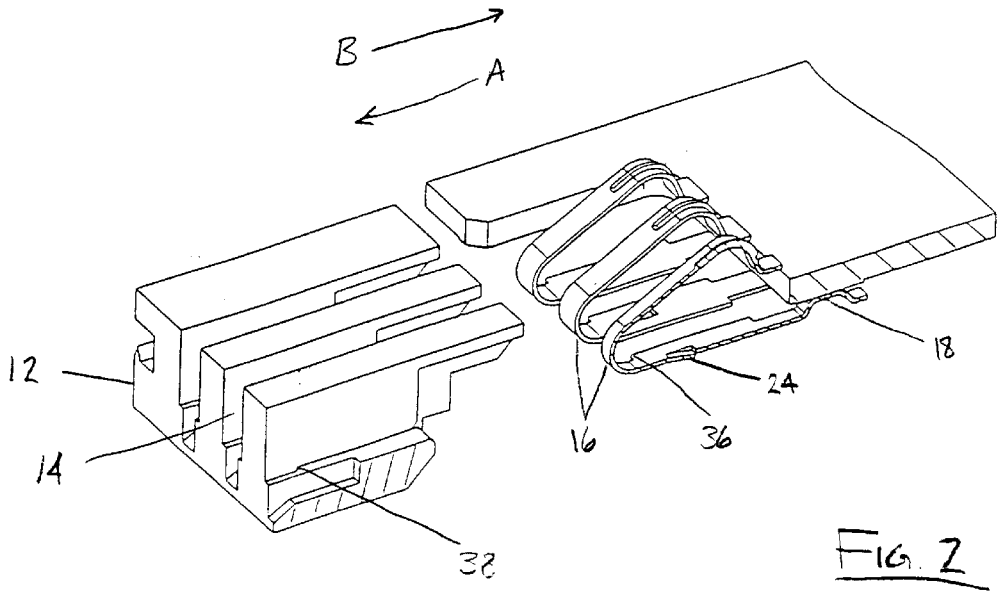
FIG. 2 shows the connector of FIG. 1 after the contacts have been released from the housing.
Figure 4:
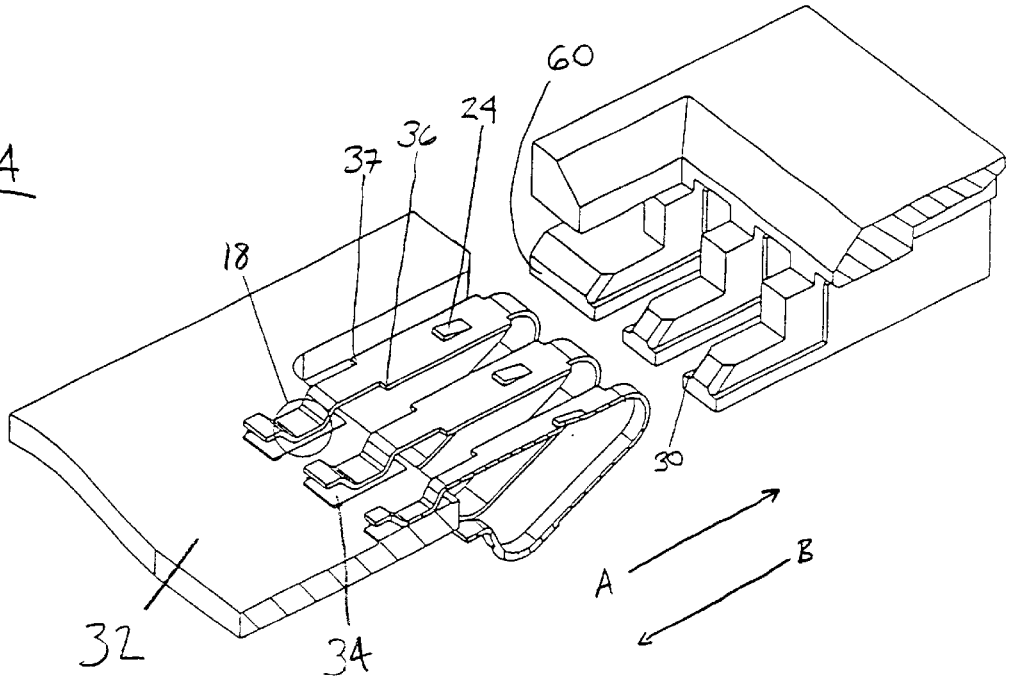
FIG. 4 is a cut-away view of from the underside of the connector of FIG. 1 after the contacts have been released from the housing.

As shown in FIGS. 2 and 4, contact body 22 includes both depending tang 24 and contact shoulders 36, 37. Contacts 16 are insertable into cavities 14 of housing 12 in an insertion direction A. Contact shoulders 36, 37 limit the extent to which contact 16 may be inserted into housing 12 by abutting against cavity shoulders 38, 39. For purposes of clarity, cavity shoulder 39 is not shown but is positioned transversely across cavity 14 from cavity shoulder 38. As contact 16 is inserted into cavity 14, depending tang 24 deflects towards contact body 22 until it is positioned adjacent locking shoulder 26, at which point tang 24 extends away from contact body 22 into interfering engagement with locking shoulder 26. The interfering engagement between tang 22 and locking shoulder 26 prevents contact 16 from being withdrawn from housing 12 in a withdrawal direction B, opposite to insertion direction A.

With PCB 32 soldered to one end of contact 16, and with contact 16 securely retained within housing 12, connector 10 provides for mating electrical connection between wiping engagement elements 20 and the contacts of another electrical connection component, not shown, thereby enabling PCB 32 to function as designed.

The present invention is more specifically directed to a later phase in the life cycle of PCB 32, where the need arises for PCB 32 to be separated from connector 10 and reworked for overhaul or maintenance purposes. As contact 16 is positively retained within housing 12 and soldered to PCB 32, current rework procedures would call for detaching connector 10 from PCB 32 by cutting contact body 22 near solder tail 18. Heat would then be applied to the solder connection between solder tail 18 and PCB 32 to disconnect solder tail 18. Once PCB 32 had been reworked, a new connector 10 would then be attached to PCB 32 as before. As previously noted, the cutting stresses applied to contact 16 can translate into shearing forces and bending moments at solder pad 34 which can cause solder pad 34 to lift or detach from PCB 32 or scratch the masked surfaces of PCB 32.

The present invention obviates the need for cutting the contacts 16 by providing for the quick and easy release of contacts 16 from housing 12 while still soldered to PCB 32. Housing 12 provides an access aperture 40 which communicates with cavity 14 and renders tang 24 accessible. A separation tool 42, shown in FIG. 5, having tang-engaging prongs 44 may engage housing 12 so that each prong 44 is inserted into each access aperture 40 to deflectingly engage each tang 24 towards contact body 22 and out of interfering engagement with the locking shoulders 26. With each tang 24 now out of interfering engagement with its associated locking shoulder 26, PCB 32 may be moved in the withdrawal direction B from engagement with housing 12 with each contact 16 still in soldered connection therewith, as shown in FIGS. 2 and 4. Each contact 16 may be disconnected from PCB 32 by the present method of separating solder tail 18 from solder pad 34. The present invention thereby eliminates the risk of damage to PCB 32 resulting from cutting the solder tails 18 from connector 10.

Figure 5:
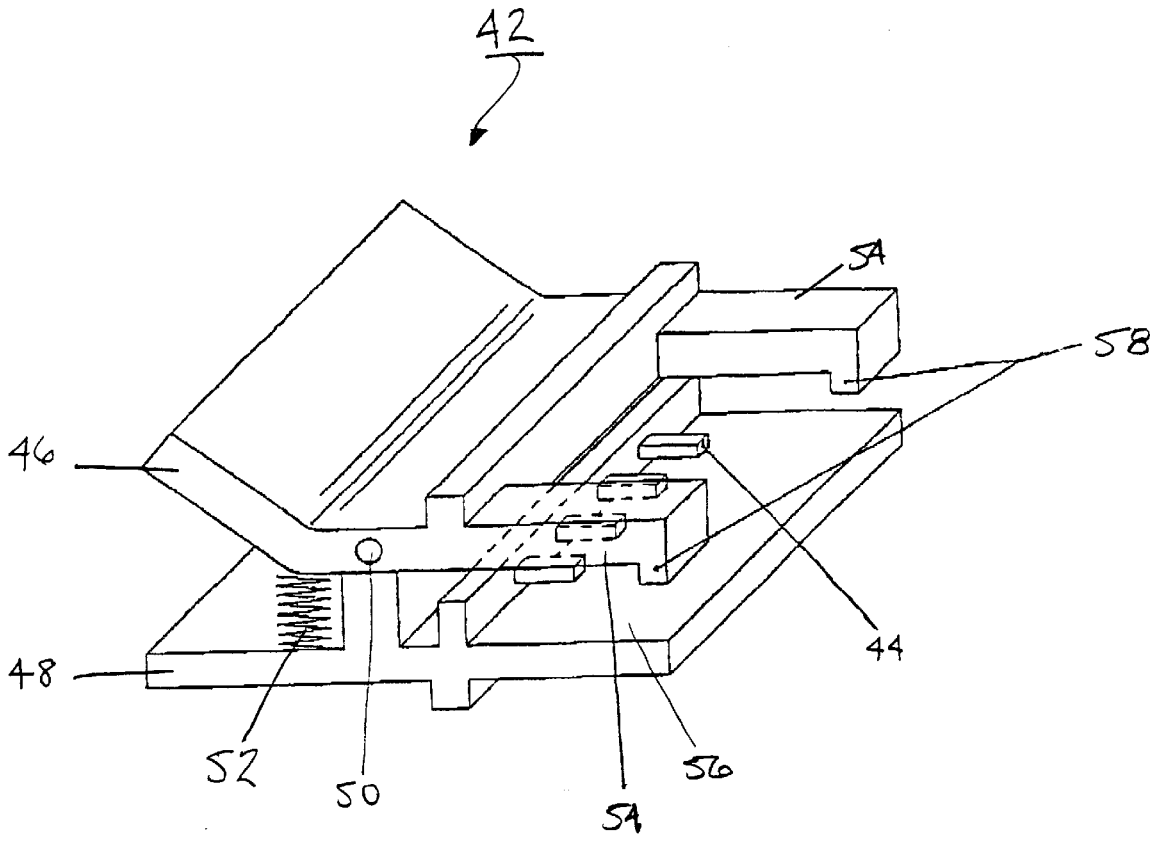
FIG. 5 depicts a tool for separating the contacts from the housing of the connector of FIG. 1.

With further reference to FIG. 5, separation tool 42 is an actuatable assembly having a first member 46 which is pivotally attached to a second member 48 at a pivot location 50. A spring 52 is interposed between first member 46 and second member 48 on one side of pivot location 50. Spring 52 biases first member 46 and second member 48 to a closed position. Separation tool 42 further includes elongate grappling arms 54 at one end of first member 46. Grappling arms 54 are in spaced opposition to a holding member 56 formed at one end of second member 48. The free ends of grappling arms 54 include hookfaces 58 which engage the top-forward surfaces 60 of housing 12 (FIGS. 1 and 4) without blocking the passage of any wiping engagement member 20 as it is withdrawn though its cavity 14 when separation tool 42 is in the closed position. In the closed position, each tang-engaging prong 44 extends far enough into its associated access aperture 40 to deflect the associated tang 24 away from interfering engagement with its opposing locking shoulder 26 so that all of the contacts 16 may be simultaneously withdrawn from housing 12 with the PCB 32.

Figure 6:
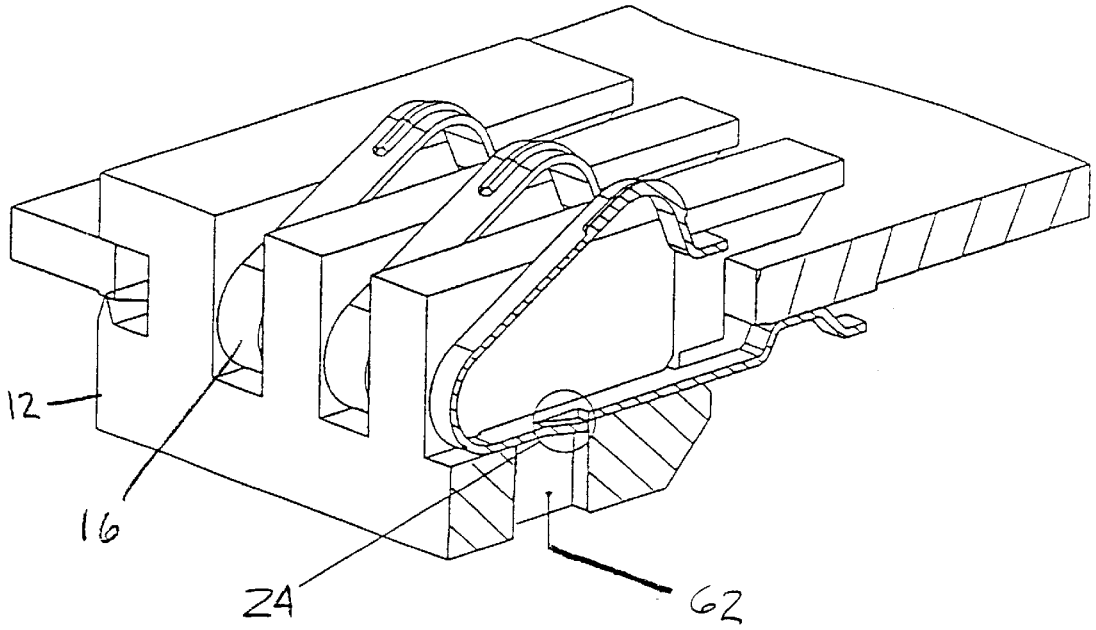
FIG. 6 depicts an alternate embodiment of the connector of the present invention.

Although access aperture 40 is shown to extend in-line with, or parallel to contact body 22, it is also contemplated that the access aperture may be differently disposed with respect to contact body 22. For example, FIG. 6 shows an alternate embodiment of the present invention whereby access aperture 62 is formed adjacent locking shoulder 26 so as to provide a more perpendicular engagement between the prongs of a separation tool (not shown) and each tang 24.

While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector assembly, comprising:

a plurality of elongate contacts, each of said contacts connected to a printed circuit board having a solder point at one end, a deflectable wiping connecting element at the other end, and an elongate body therebetween, said elongate body including a deflectable tang extending therefrom;

an insulative housing defining a plurality cavities for removably insertably receiving said elongate contact, said housing including a plurality of locking shoulders, for engaging said plurality of deflectable tang, and a tang access aperture defined by said housing extending in a direction substantially parallel to said a plurality of cavities, said plurality of tang access apertures communicating with said a plurality of cavities for rendering said plurlity of deflectable tangs;

a removal tool;

wherein said a plurality of contacts is insertable into said a plurality of cavities of said housing in an insertion direction, said plurality deflectable tangs being insertable into interfering engagement with said plurality of locking shoulders, so as to prevent movement of said a plurality of contact in a removal direction opposite to said insertion direction, and wherein said plurality of deflectable tangs deflectively engageable by said removal tool inserted through said plurality of said plurality of tang access apertures away from interfering engagement with said locking shoulder whereby said a plurality of contacts may be removed from said housing in said removal direction.

2. The connector of claim 1, wherein said solder point extends externally from said housing to permit connection to a printed circuit board, and wherein said connecting element is supported in said cavity so as to provide deflectable wiping connection with a mating electrical contact.

3. The connector of claim 2, wherein said solder point is connected to said printed circuit board by solder.

4. The connector of claim 1, wherein said elongate body includes a flange, said flange providing interfering engagement with said housing to limit the insertion of said contact into said cavity.

* * * * *